US008105083B2

(12) United States Patent
Sanchez

(10) Patent No.: US 8,105,083 B2
(45) Date of Patent: Jan. 31, 2012

(54) FOAM TEETH CLEANING AND STAIN REMOVING DEVICE

(76) Inventor: Anthony R Sanchez, Hudson, WI (US)

( * ) Notice: Subject to any disclaimer, the term of this patent is extended or adjusted under 35 U.S.C. 154(b) by 159 days.

(21) Appl. No.: 12/466,386

(22) Filed: May 15, 2009

(65) Prior Publication Data

US 2009/0286203 A1 Nov. 19, 2009

Related U.S. Application Data

(60) Provisional application No. 61/054,159, filed on May 18, 2008.

(51) Int. Cl.
*A61C 15/00* (2006.01)

(52) U.S. Cl. ..... 433/216; 15/244.1

(58) Field of Classification Search ..... 433/141, 433/216; 15/244.1, 244.4
See application file for complete search history.

(56) References Cited

U.S. PATENT DOCUMENTS

| | | | | | |
|---|---|---|---|---|---|
| 1,708,050 | A * | 4/1929 | Burlew | 15/188 |
| 1,924,337 | A * | 8/1933 | Troupa | 15/244.1 |
| 2,244,699 | A * | 6/1941 | Hosey | 15/188 |
| 2,364,205 | A * | 12/1944 | Fuller | 601/141 |
| 2,476,201 | A * | 7/1949 | Eugenia | 15/188 |
| 3,458,268 | A * | 7/1969 | Wozab et al. | 401/261 |
| 5,040,260 | A * | 8/1991 | Michaels | 15/167.1 |
| 5,392,482 | A * | 2/1995 | Drulias et al. | 15/104.94 |
| 6,205,611 | B1 * | 3/2001 | Vigil | 15/244.1 |
| 6,608,118 | B2 * | 8/2003 | Kosaka et al. | 521/187 |
| 2005/0066459 | A1 * | 3/2005 | Pinyayev et al. | 15/28 |

* cited by examiner

*Primary Examiner* — Ralph Lewis
(74) *Attorney, Agent, or Firm* — Michael Ries

(57) ABSTRACT

A device for removing stains and polishing a user's teeth including a handle portion and a brushing head mounted on said handle, the brushing head comprises a support member; a pad of melamine foam coupled to the support member, and at least one tooth projecting outward from the melamine foam pad; wherein the at least one tooth, when rubbed against a users teeth, removes stains from the user's teeth.

3 Claims, 2 Drawing Sheets

FOAM TEETH CLEANING AND STAIN REMOVING DEVICE

This application claims priority to U.S. Provisional application Ser. No. 61/054,159 Filed 18-May-2008 which is incorporated herein by reference in its entirety.

BACKGROUND OF THE INVENTION

1. Field of the Invention

This invention relates generally to an oral hygiene device and more particularly to a device for removing stains and polishing a user's teeth.

2. Description of the Related Art

The present invention relates to a toothbrush type of device having improved abrasion, cleaning and polishing performance attributes.

To clean one's teeth, a person will use a bristle type of tooth brush together with a tooth cleaning paste or gel. Teeth generally become more darkly pigmented with age and exposure to tea and coffee. To reverse this darkening process, a whiting agent such as an abrasive is frequently added to the tooth cleaning agent to remove pigmentation which adheres onto the surface of the teeth. While being somewhat effective, the whiting agent in the tooth cleaning agent normally consists of one or more abrasive substance which is provide to abrasively clean, polish and remove stains, plaque and tartar from the surfaces of teeth. It has been found that the abrasive substance in combination with a bristle type of tooth brush removes only the surface stains and leaves dark pigmentation that is located within small indentations on the surface of teeth. Thus, the whitening effect of the whitening agent in the tooth cleaning agent is extremely limited.

Conventional tooth brushes normally comprise tufts of bristles in rows that are secured to a base member which is connected to a handle. The bristles are usually designated as being soft, medium or hard to indicate their stiffness. Usually the tufts are pointed at their outer ends to allow the bristles to clean between the teeth.

Most of the bristles now used are made of "Nylon", a plastic type of material which are water proof, durable, and relatively hard. In addition they possess a high degree of resiliency.

Prior to using plastic bristles, hog bristles were commonly used. Hog bristles are not as durable as plastic bristles, and will become soft when wetted with water. However, as hog bristles wear down they expose natural abrasive substances that can polish a user's teeth.

Regardless of the material of the bristles in a tooth brush, they do not effectively remove teeth stains whether used alone or together with a tooth paste or gel. Tooth paste and tooth gel normally contain, in addition to other ingredients, abrasive particle. As the hard bristles of a tooth brush are moved over a persons teeth, the bristles either push the abrasive ahead or to one side, or they scratch the teeth by pressing the abrasive particles against the teeth.

What is desired is a tooth brush that is adapted to gently and uniformly remove teeth stains and polish a user's teeth without using a tooth paste or gel.

SUMMARY OF THE INVENTION

To overcome the shortcomings noted above, there is disclosed in one embodiment a tooth brush comprising a device for removing stains and polishing a user's teeth including a handle portion and a brushing head mounted on said handle, the brushing head comprising:

a support member;

a pad of melamine foam coupled to said support member, and at least one tooth projecting outward from said melamine foam pad;

wherein said at least one tooth, when rubbed against a users teeth, removes stains from the user's teeth.

In another embodiment there is disclosed a method of removing stains and polishing teeth of a person comprising:

wetting a pad of melamine foam with a liquid; and rubbing said melamine foam against said user's teeth.

The foregoing has outlined, rather broadly, the preferred feature of the present invention so that those skilled in the art may better understand the detailed description of the invention that follows. Additional features of the invention will be described hereinafter that form the subject of the claim of the invention. Those skilled in the art should appreciate that they can readily use the conception and specific embodiment as a base for designing or modifying the structures for carrying out the same purposes of the present invention and that such other features do not depart from the spirit and scope of the invention in its broadest form.

BRIEF DESCRIPTION OF THE DRAWINGS

Other aspects, features, and advantage of the present invention will become more fully apparent from the following detailed description, the appended claims, and the accompanying drawings in which similar elements are given similar reference numerals.

DETAILED DESCRIPTION OF THE INVENTION

The primary function of the bristles of a toothbrush is to rub abrasive particles contained in toothpaste across the surfaces of a user's teeth to remove by abrasive action tooth deposits such as stains, plaque, tartar and the like while delivering various active ingredients such as fluoride, anti-tartar, anti-gingivitis ingredients, etc. to the teeth being cleaned.

Studies have shown that the most aggressive mechanical cleansing with a toothpaste/toothbrush combination neither fully removes teeth stains nor polishes a user's teeth.

Accordingly, a more efficient tooth stain removing and polishing toothbrush is needed.

The present invention has as its primary objective the cleaning and polishing of teeth by using a melamine foam tooth cleaning device that both removes teeth stains and polishes a user's teeth either with or without a tooth paste or a tooth gel.

A liquid such as water is importance in cleaning teeth. A bristle type toothbrush with plastic bristles is not absorbent and, therefore, as water is needed for cleaning and polishing teeth, a tooth brush with plastic bristles has very limited polishing ability. Another limitation of a bristle type of toothbrush is that the sharp and pointed ends of the bristles may actually injure gum tissues.

As noted above, teeth generally become more darkly pigmented with age and exposure to such materials as tea and coffee, and it has long been a goal of dentistry to provide a means to safely and effectively reverse this darkening process. Currently, dark pigmentation on the surface of teeth is removed with a tooth paste or gel that contains abrasives which may be augmented with a solvent. This process only removes surface stains. Dark pigmentation located in small pockets on the surface of teeth are, at best, only slightly lightened.

Figure 2:
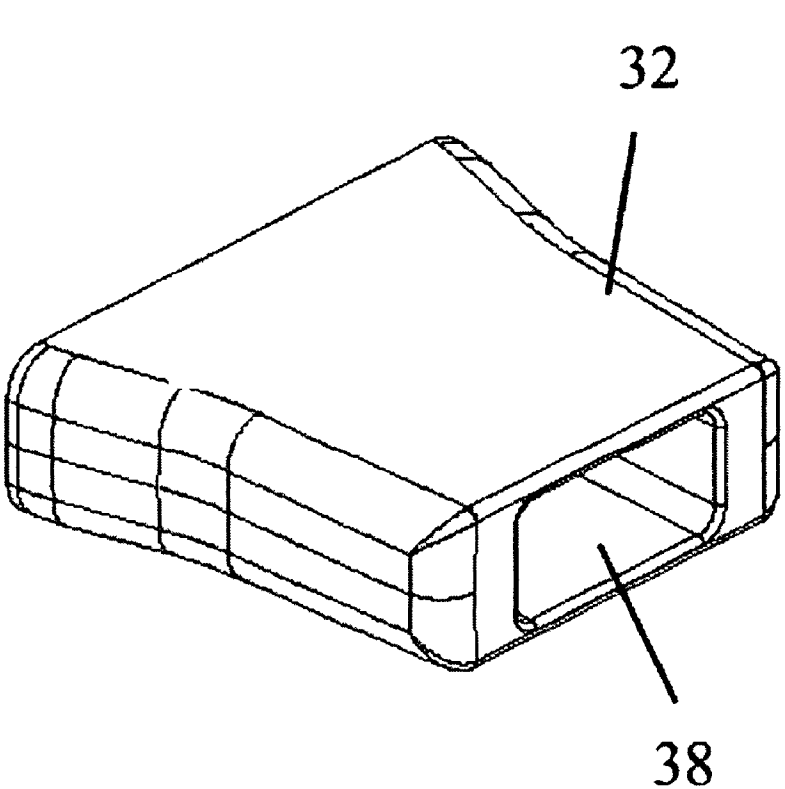
FIG. 2 is a perspective view of the rear of the first housing shown in FIG. 1.
Figure 1:
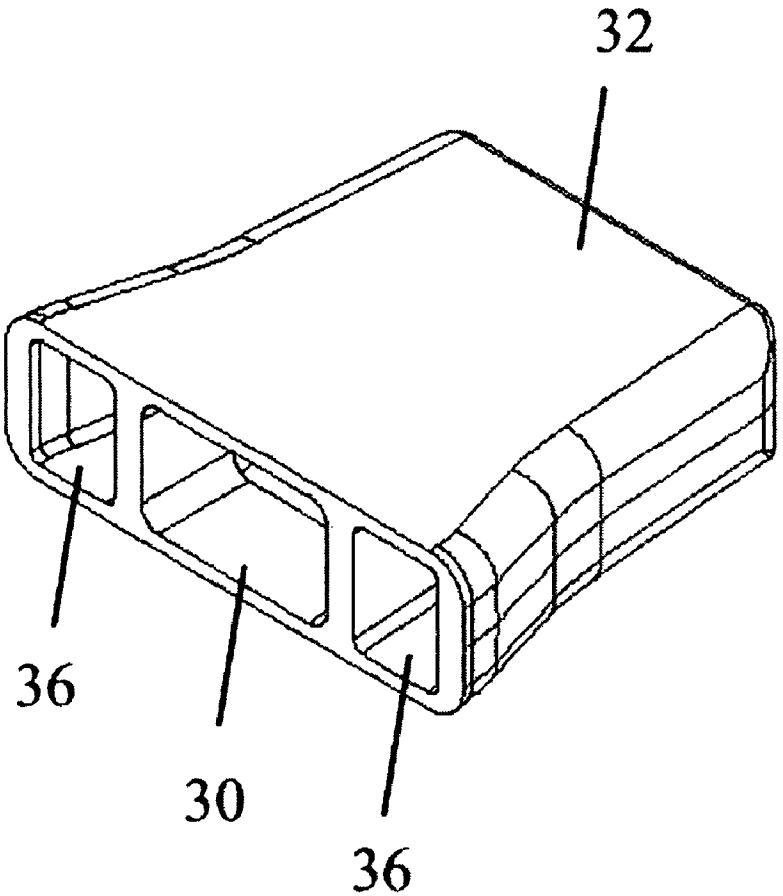
FIG. 1 is a perspective view of the front of a first housing that mates with a second housing that provides support for a melamine foam tooth cleaning and polishing device.
Figure 4:
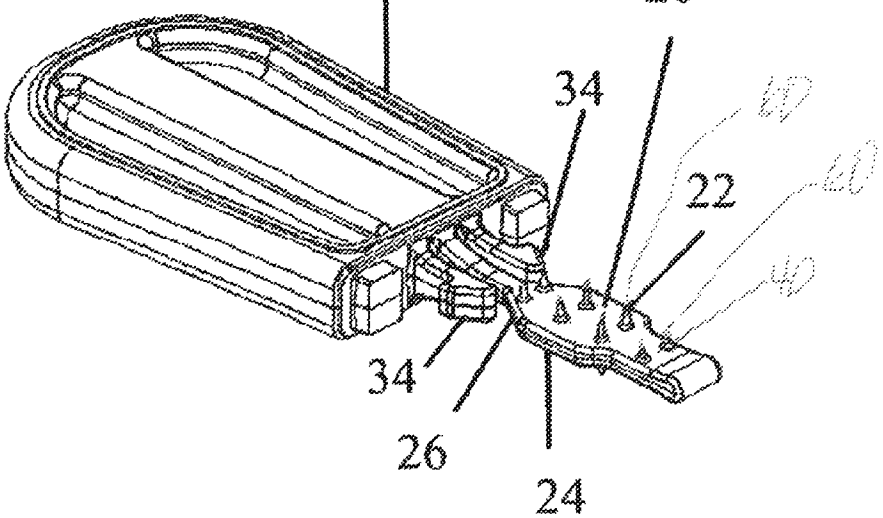
FIG. 4 is a perspective view of the front of the second housing shown in FIG. 3.
Figure 3:
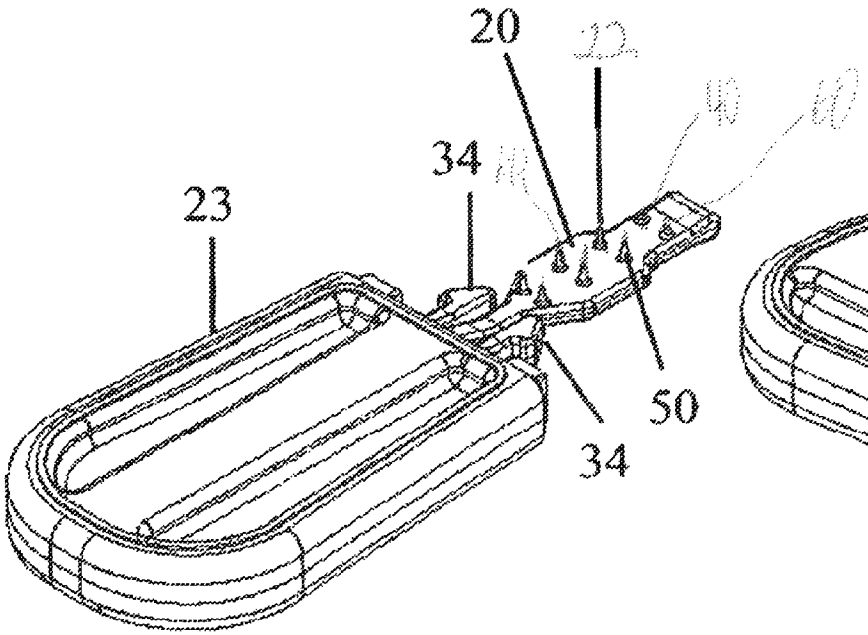
FIG. 3 is a perspective view of the rear of a second housing that mates with the first housing of FIGS. 1, 2 and is configured to support a handle of a melamine foam tooth cleaning and polishing device.

Looking at FIGS. 3 and 4, in an embodiment of the present invention, a melamine foam base pad 20 having melamine teeth 22 are disposed on the head of a toothbrush 24. The teeth 22 can have a cone shape where the tip 60 of the cone can be flat or pointed. Thus, the cone can be truncated 40. The melamine foam pad and the teeth of melamine foam, when wet with a liquid such as water, is very effective in removing stains and polishing teeth. The stain removal and polishing of teeth does not require the use of a tooth paste or a tooth gel. All that is needed is that the melamine pad and teeth are wet with a liquid such as plain water. The melamine teeth, when wet, can remove stains and polish a user's teeth by rubbing the user's teeth without scratching the surfaces of the teeth. It is understood that tooth paste or tooth gel can be used either with or in place of water with the melamine foam pad and melamine teeth here disclosed for stain removal and tooth polishing.

The melamine foam base pad 20 and conical shaped teeth 22 can be mounted on the end of a handle 26 to provide a toothbrush for removing teeth stains and polishing the teeth. The conical shaped teeth can span the entire handle, or only a portion of the handle. They can be arranged to be in columns and/or rows that are either in alignment, are staggered, or are randomly positioned. A melamine foam base pad having melamine teeth can be mounted on a replaceable component of a tooth brush to provide a tooth brush having melamine teeth that are replaceable.

The melamine foam teeth can be spaced apart and aligned to form rows and columns, or they can be offset relative to each other to provide an irregular pattern. The tooth brush having melamine foam teeth can be either a manual toothbrush for removing stains and polishing teeth, or the tooth brush can be an electric toothbrush.

The melamine foam teeth cleaning device removes stains from teeth and also polishes the teeth to make the teeth surfaces cleaner and whiter due to its ability to access minute crevices, holes and spaces that conventional tooth brushes having brushes can not readily do.

Melamine foam is a foam type of material consisting of a formaldehyde melamine sodium bisulfite copolymer. The tooth brush having melamine foam teeth here disclosed can remove stains from teeth because of its microporous properties. The microporous properties of the melamine foam base pad and teeth can effectively remove difficult external stains from relatively smooth surfaces. The open cell foam is not only microporous, but its polymeric substance is also extremely hard. Thus, it works in a manner that is similar to the way that sandpaper works, but on as smaller scale which allows it to get into tiny grooves and small indents such as pits on the surface of teeth. On a larger scale, the material is soft to the touch because bubbles in the melamine foam interconnect. Melamine foam has a structure that is more like a maze of fiberglass strands and, when moist or damp, effectively cleans and polishes the surfaces of teeth.

Returning to FIGS. 3 and 4, the melamine foam tooth cleaning structure has, at one end a handle 26 and at the other end a melamine pad having projecting teeth. The handle is held by a person when he/she is using the tooth brush to clean and polish his/her teeth. In use, a user while holding the handle, dampens the melamine foam pad and melamine teeth with water, saliva or another type of liquid, and then proceeds to scrub or rub his/her teeth with the melamine foam teeth on the melamine pad. The melamine foam pad and projecting teeth can be on a tooth brush handle or a stick.

In an embodiment a melamine pad without teeth can be rubbed on a user's teeth with finger pressure to obtain the cleaning and polishing desired.

The melamine foam teeth and supporting pad can be located on the end of a tooth brush handle, a stick, or applied with finger pressure to clean and polish teeth.

Melamine foam that comes from a manufacturer may have trace amounts of formaldehyde. To eliminate the formaldehyde, the melamine foam pad and conical shaped teeth should be treated with heat and pressure. The trace amounts of formaldehyde are below any regulatory standards but can be reduce further by heating the foam to a temperature where the formaldehyde in the foam is substantially destroyed. The process of destroying the formaldehyde can be by heat alone or a combination of heat and pressure.

In addition to using heat and pressure to remove formaldehyde, heat and pressure is applied to melamine foam to increase its density to a desired value. Increasing the density makes the melamine stiffer, stronger, and longer lasting which results in a pod and/or brush that can clean better.

In addition to using the device here disclosed for cleaning and polishing teeth, it can also be used to polish fingernails.

In another embodiment of the device here disclosed, the foam pad can be used as a support member for at least one group of plastic bristles 50, see FIG. 3, in combination with a plurality of cone shaped teeth of melamine foam.

In still another embodiment the melamine foam pad can support teeth of different sizes and/or shapes, see FIG. 4, and this combination can also include at least one group of plastic bristles.

In still another embodiment the handle of the tooth brush can be straight or curved to allow a user to reach difficult areas of the mouth.

In still another embodiment flavoring can be added to the melamine foam pad and teeth of the tooth brush.

Referring to FIGS. 1-4, tooth brush 24 is coupled to the front of a second housing 28 which is designed to mate with first housing 32. When housing 28 is mated to housing 32, the tooth brush 24 is located within opening 30 of the first housing and locking fingers 34 are located in receiving openings 36. Opening 38 in the rear of first housing provides ventilation for the tooth brush when the first and second housings are coupled together and the tooth brush is located within the front housing.

Although a few examples of the present invention have been shown and described, it would be appreciated by those skilled in the art that changes might be made in the embodiments without departing from the principles and spirit of the invention, the scope of which is defined in the claims and their equivalents.

What is claimed is:

1. A method for removing stains and polishing a plurality of teeth, comprising:

treating a foam pad of melamine with a plurality of melamine teeth with heat and pressure to remove formaldehyde and increase said melamine density;

wetting a pad of melamine foam with a liquid; and rubbing said melamine pad against said teeth.

2. The method according to claim 1, wherein said liquid is water.

3. The method according to claim 1, wherein said melamine pad rubs toothpaste or tooth gel onto said teeth.

* * * * *